US005909922A

United States Patent [19]

Dugas

[11] Patent Number: 5,909,922

[45] Date of Patent: Jun. 8, 1999

[54] CHAIR ARM-MOUNTED RESTING SURFACE FOR A COMPUTER PERIPHERAL

[76] Inventor: John E. Dugas, 8064 Olivia Dr., Denham Springs, La. 70726

[21] Appl. No.: 09/015,105

[22] Filed: Jan. 29, 1998

[51] Int. Cl.[6] ..... A47C 7/62

[52] U.S. Cl. ..... 297/188.18; 248/188.1; 108/43; 108/47

[58] Field of Search ..... 297/188.18, 188.07, 297/188.06, 188.2, 145, 153; 108/43, 44, 45, 47; 248/298.1, 188.1

[56] References Cited

U.S. PATENT DOCUMENTS 1,453,186 4/1923 Ruffin, Jr. ..... 108/47 X
2,697,018 12/1954 Georgides ..... 108/43
2,867,401 1/1959 Sheahan ..... 108/47 X
4,311,099 1/1982 Roberts ..... 297/188.18 X
4,575,149 3/1986 Forestal et al. ..... 108/47 X
5,368,266 11/1994 Allen ..... 108/47 X

*Primary Examiner*—Laurie K. Cranmer

[57] ABSTRACT

A resting surface attachable to a chair arm for supporting a computer peripheral is provided including a top resting plate and at least a pair of legs coupled to the top resting plate. Further provided is a clamping assembly for clamping the legs to the chair arm such that a computer peripheral may be situated on the top resting plate during use.

7 Claims, 2 Drawing Sheets

CHAIR ARM-MOUNTED RESTING SURFACE FOR A COMPUTER PERIPHERAL

BACKGROUND OF THE INVENTION

1. Field of the Invention

The present invention relates to computer desks and more particularly pertains to a new chair arm-mounted resting surface for a computer peripheral for providing a surface close to a chair in which a computer user is sitting to support a computer peripheral.

2. Description of the Prior Art

The use of computer desks is known in the prior art. More specifically, computer desks heretofore devised and utilized are known to consist basically of familiar, expected and obvious structural configurations, notwithstanding the myriad of designs encompassed by the crowded prior art which have been developed for the fulfillment of countless objectives and requirements.

Known prior art computer desks include U.S. Pat. No. 5,388,530; U.S. Pat. No. 5,081,936; U.S. Pat. No. 4,909,159; U.S. Pat. No. 5,030,128; U.S. Pat. No. 5.377,085; and U.S. Pat. Des. 287,741.

In these respects, the chair arm-mounted resting surface for a computer peripheral according to the present invention substantially departs from the conventional concepts and designs of the prior art, and in so doing provides an apparatus primarily developed for the purpose of providing a surface close to a chair in which a computer user is sitting to support a computer peripheral.

SUMMARY OF THE INVENTION

In view of the foregoing disadvantages inherent in the known types of computer desks now present in the prior art, the present invention provides a new chair arm-mounted resting surface for a computer peripheral construction wherein the same can be utilized for providing a surface close to a chair in which a computer user is sitting to support a computer peripheral.

The general purpose of the present invention, which will be described subsequently in greater detail, is to provide a new chair arm-mounted resting surface for a computer peripheral apparatus and method which has many of the advantages of the computer desks mentioned heretofore and many novel features that result in a new chair arm-mounted resting surface for a computer peripheral which is not anticipated, rendered obvious, suggested, or even implied by any of the prior art computer desks, either alone or in any combination thereof.

To attain this, the present invention generally comprises a top resting plate having a planar square configuration with a top face, a bottom face and a periphery formed therebetween. The bottom face of each plate has a plurality of linearly aligned ratchet teeth extending along a central extent thereof. As best shown in FIGS. 2 & 3, a pair of guides are situated along side edges of the ratchet teeth adjacent opposite ends thereof. Each guide is defined by a pair of L-shaped members depending from the top resting plate. Next provided are two fixed legs each having an arcuate configuration. A bottom end of each leg has a rectangular pad mounted thereon. Each leg has a top end fixed on opposite sides of the top resting plate adjacent to a common end, as shown in FIG. 3. Associated therewith are two pivoting legs each having an arcuate configuration, similar to the fixed legs. A bottom end of each of the pivoting legs has a rectangular pad mounted thereon. A top end of each pivoting leg is pivotally coupled on opposite sides of the top resting plate adjacent to a common end. As such, the pads of the pivoting legs are adapted to be pivoted toward and away from the pads of the fixed legs. Next provided is a leg clamping assembly including a thin rectangular strip slidably situated within the guides. During use, the strip slides between both the fixed and pivoting legs. The strip has a first end. A second end of the strip is equipped with a pair of arms extending downwardly therefrom each of which is pivotally coupled to an intermediate extent of an associated one of the pivoting legs. By this structure, the leg clamping assembly is adapted for selectively moving with the pads of the pivoting legs. A top face of the strip has a spring biased tab extending upwardly therefrom for engaging the ratchet teeth of the top resting plate. Such engagement serves for maintaining the pads of the pivoting legs in the proximity of the pads of the fixed legs. Finally, an unlocking assembly is provided including a thin rectangular strip slidably situated within the guides below the strip of the leg clamping assembly. The current strip slides between both the fixed and pivoting legs. A first end of the strip of the unlocking assembly is equipped with a gripping lip depending downwardly therefrom adjacent an end of the top resting plate opposite that of the strip of the leg clamping assembly. A top face of the strip of the unlocking assembly has a bevel block extending upwardly therefrom. This bevel block extends through a slot formed in the strip of the leg clamping assembly for disengaging the spring biased tab from the ratchet teeth when slid outward.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new chair arm-mounted resting surface for a computer peripheral apparatus and method which has many of the advantages of the computer desks mentioned heretofore and many novel features that result in a new chair arm-mounted resting surface for a computer peripheral which is not anticipated, rendered obvious, suggested, or even implied by any of the prior art computer desks, either alone or in any combination thereof.

It is another object of the present invention to provide a new chair arm-mounted resting surface for a computer peripheral which may be easily and efficiently manufactured and marketed.

It is a further object of the present invention to provide a new chair arm-mounted resting surface for a computer peripheral which is of a durable and reliable construction.

An even further object of the present invention is to provide a new chair arm-mounted resting surface for a computer peripheral which is susceptible of a low cost of manufacture with regard to both materials and labor, and which accordingly is then susceptible of low prices of sale to the consuming public, thereby making such chair arm-mounted resting surface for a computer peripheral economically available to the buying public.

Still yet another object of the present invention is to provide a new chair arm-mounted resting surface for a computer peripheral which provides in the apparatuses and methods of the prior art some of the advantages thereof, while simultaneously overcoming some of the disadvantages normally associated therewith.

Still another object of the present invention is to provide a new chair arm-mounted resting surface for a computer peripheral for providing a surface close to a chair in which a computer user is sitting to support a computer peripheral.

Even still another object of the present invention is to provide a new chair arm-mounted resting surface for a computer peripheral that includes a top resting plate and at least a pair of legs coupled to the top resting plate. Further provided is a clamping assembly for clamping the legs to the chair arm such that a computer peripheral may be situated on the top resting plate during use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
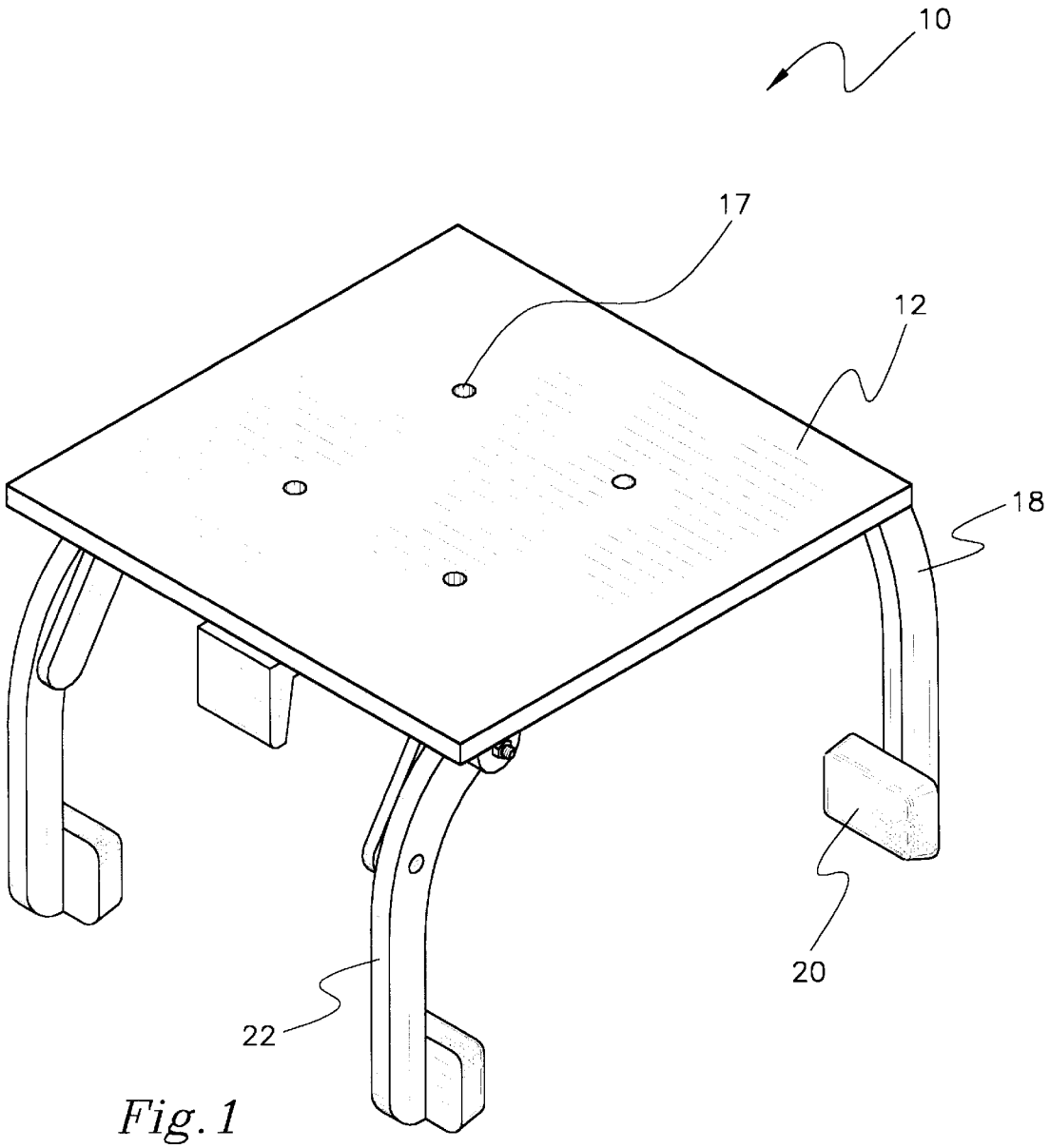
FIG. 1 is a perspective view of a new chair arm-mounted resting surface for a computer peripheral according to the present invention.

With reference now to the drawings, and in particular to FIGS. 1 through 5 thereof, a new chair arm-mounted resting surface for a computer peripheral embodying the principles and concepts of the present invention and generally designated by the reference numeral 10 will be described.

Figure 2:
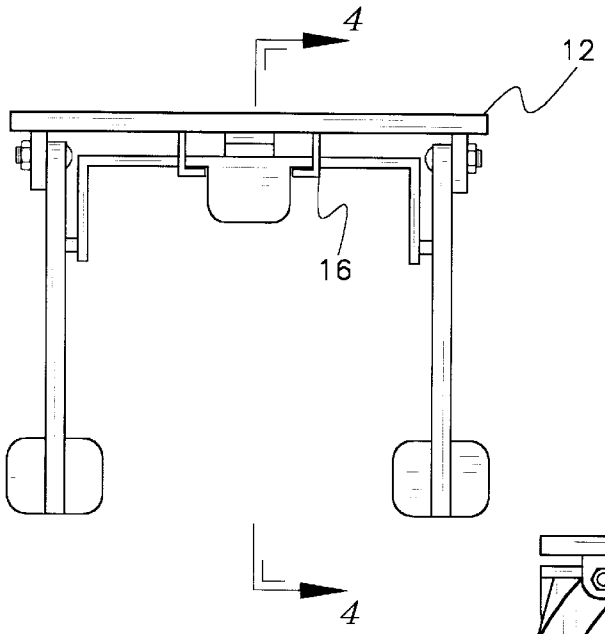
FIG. 2 is an end view of the present invention.
Figure 3:
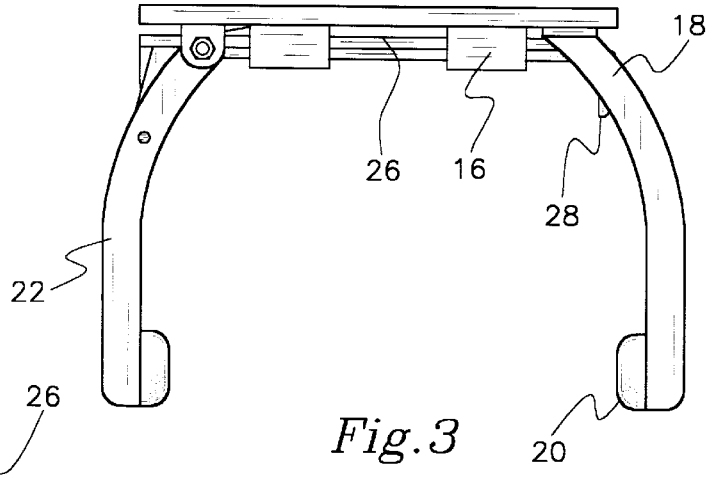
FIG. 3 is a side view of the present invention.
Figure 4:
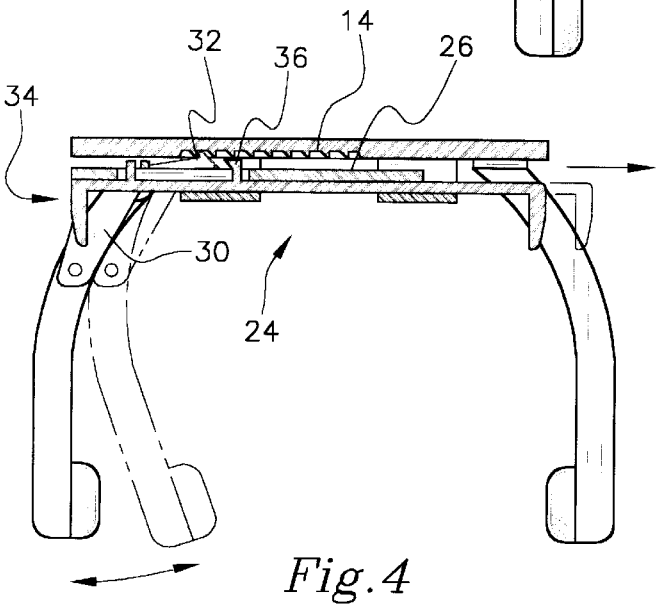
FIG. 4 is a cross-sectional view of the present invention taken along line 4—4 shown in FIG. 2.

The present invention, designated as numeral 10, includes a top resting plate 12 having a planar square configuration with a top face, a bottom face and a periphery formed therebetween. The bottom face of each plate has a plurality of linearly aligned ratchet teeth 14 extending along a central extent thereof. As best shown in FIGS. 2 & 3, a pair of guides 16 are situated along side edges of the ratchet teeth adjacent opposite ends thereof. Each guide is defined by a pair of L-shaped members depending from the top resting plate. For allowing the coupling of a joy stick or other fixed computer peripheral to the top resting plate by way of screws, removable posts or the like, the top resting plate preferably has four apertures 17 situated at distinct corners of an imaginary square thereon.

Next provided are two fixed legs 18 each having an arcuate configuration. A bottom end of each leg has a rectangular pad 20 mounted thereon. Each leg has a top end fixed on opposite sides of the top resting plate adjacent to a common end, as shown in FIG. 3.

Figure 5:
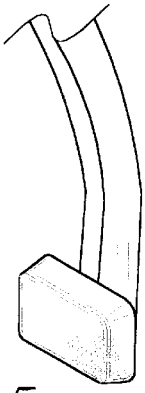
FIG. 5 is a perspective view of the present invention showing one of the legs of an alternate embodiment.

Associated therewith are two pivoting legs 22 each having an arcuate configuration, similar to the fixed legs. It should be noted that the legs may be equipped with a radius of curvature which is tighter, as shown in FIG. 5. A bottom end of each of the pivoting legs has a rectangular pad mounted thereon. A top end of each pivoting leg is pivotally coupled on opposite sides of the top resting plate adjacent to a common end. As such, the pads of the pivoting legs are adapted to be pivoted toward and away from the pads of the fixed legs.

Next provided is a leg clamping assembly 24 including a thin rectangular strip 26 slidably situated within the guides. During use, the strip slides between both the fixed and pivoting legs. The strip has a first end. A second end of the strip is equipped with a pair of arms 30 extending downwardly therefrom each of which is pivotally coupled to an intermediate extent of an associated one of the pivoting legs. So that the legs remain in general coplanar relationship with the arms 30, a pair of extenders are coupled between the strip and legs, as shown in FIG. 2.

By this structure, the leg clamping assembly is adapted for selectively moving with the pads of the pivoting legs. This action allows the clamping of the legs to an arm of a chair. A top face of the strip has a spring biased tab 32 extending upwardly therefrom for engaging the ratchet teeth of the top resting plate. Such engagement serves for maintaining the pads of the pivoting legs in the proximity of the pads of the fixed legs.

Finally, an unlocking assembly 34 is provided including a thin rectangular strip slidably situated within the guides below the strip of the leg clamping assembly. The current strip slides between both the fixed and pivoting legs. A first end of the strip of the unlocking assembly is equipped with a gripping lip depending downwardly therefrom adjacent an end of the top resting plate opposite that of the strip of the leg clamping assembly. It should be noted that each of the strips of the present invention has a width approximately ⅓ that of the top resting plate.

A top face of the strip of the unlocking assembly has a bevel block 38 extending upwardly therefrom. This bevel block extends through a slot formed in the strip of the leg clamping assembly for disengaging the spring biased tab from the ratchet teeth when slid outward.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A resting surface attachable to a chair arm for supporting a computer peripheral comprising, in combination:

a top resting plate having a planar square configuration with a top face, a bottom face and a periphery formed therebetween, the bottom face having a plurality of linearly aligned ratchet teeth extending along a central extent thereof, a pair of guides situated along side edges of the ratchet teeth adjacent opposite ends thereof, each guide being defined by a pair of L-shaped members depending from the top resting plate;

two fixed legs each having an arcuate configuration, a bottom end having a rectangular pad mounted thereon, and a top end fixed on opposite sides of the top resting plate adjacent to a common end;

two pivoting legs each having an arcuate configuration, a bottom end having a rectangular pad mounted thereon, and a top end pivotally coupled on opposite sides of the top resting plate adjacent to a common end wherein the pads of the pivoting legs are adapted to be pivoted toward and away from the pads of the fixed legs;

a leg clamping assembly including a thin rectangular strip slidably situated within the guides wherein the strip slides between both the fixed and pivoting legs, the strip having a first end and a second end with a pair of arms extending downwardly therefrom and each pivotally coupled to an intermediate extent of an associated one of the pivoting legs such that the strip of the leg clamping assembly moves with the pads of the pivoting legs, a top face of the strip having a spring biased tab extending upwardly therefrom for engaging the ratchet teeth of the top resting plate for maintaining the pads of the pivoting legs in the proximity of the pads of the fixed legs; and an unlocking assembly including a thin rectangular strip slidably situated within the guides below the strip of the leg clamping assembly wherein the strip slides between both the fixed and pivoting legs, the strip having a first end with a gripping lip depending downwardly therefrom adjacent an end of the top resting plate opposite that of the strip of the leg clamping assembly, a top face of the strip of the unlocking assembly having a bevel block extending upwardly therefrom and through a slot formed in the strip of the leg clamping assembly for disengaging the spring biased tab from the ratchet teeth when slid outward.

2. A resting surface attachable to a chair arm for supporting a computer peripheral comprising:

a top resting plate;

at least a pair of legs coupled to the top resting plate; and means for clamping the legs to the chair arm such that a computer peripheral may be situated on the top resting plate during use;

wherein the means includes a pair of sliding strips one of which is adapted for lockingly clamping the legs and another of which is adapted for unlocking the legs;

wherein the strips are slidably situated within at least one guide formed on a bottom face of the top resting plate.

3. A resting surface attached to a chair arm as set forth in claim 2 wherein a pad is coupled to a lower end of each arm.

4. A resting surface attached to a chair arm as set forth in claim 2 wherein the legs include at least one fixed leg and a pivoting leg.

5. A resting surface attached to a chair arm as set forth in claim 2 wherein the means includes a ratchet teeth and spring biased tab combination.

6. A resting surface attached to a chair arm as set forth in claim 2 wherein the strips are adapted to be slid in opposite directions.

7. A resting surface attached to a chair arm as set forth in claim 2 wherein the top resting plate has at least one aperture formed on a top surface thereof.

* * * * *